United States Patent [19]

Miller

[11] 4,170,544

[45] Oct. 9, 1979

[54] HYDROCRACKING PROCESS INCLUDING UPGRADING OF BOTTOMS FRACTION OF THE PRODUCT

[75] Inventor: Stephen J. Miller, Emeryville, Calif.

[73] Assignee: Chevron Research Company, San Francisco, Calif.

[21] Appl. No.: 915,021

[22] Filed: Jun. 12, 1978

[51] Int. Cl.[2] ..... C10G 21/16

[52] U.S. Cl. ..... 208/96; 208/254 R

[58] Field of Search ..... 208/97, 96, 254 R, 251 H

[56] References Cited

U.S. PATENT DOCUMENTS

| | | | |
|---|---|---|---|
| 2,507,861 | 5/1950 | Manley | 208/254 R |
| 2,846,358 | 8/1958 | Bieber et al. | 208/251 H |
| 2,847,362 | 8/1958 | Kemp | 208/254 R |
| 3,193,496 | 7/1965 | Hartung | 208/254 R |
| 3,579,437 | 5/1971 | Wentzheimer et al. | 208/96 |
| 3,929,617 | 12/1975 | Henry et al. | 208/96 |
| 4,113,607 | 9/1978 | Miller | 208/254 R |

*Primary Examiner*—George Crasanakis

*Attorney, Agent, or Firm*—D. A. Newell; R. H. Davies; D. L. Hagmann

[57] ABSTRACT

An improved hydrocarbon hydrocracking process is disclosed wherein residual nitrogen-containing and/or polycyclic hydrocarbon impurities are extracted from bottoms of the resulting hydrocrackate by contacting the bottoms under liquid-liquid extracting conditions with a furfural solution of ferric chloride.

14 Claims, No Drawings

HYDROCRACKING PROCESS INCLUDING UPGRADING OF BOTTOMS FRACTION OF THE PRODUCT

BACKGROUND OF THE INVENTION

This invention relates to an improved hydrocarbon hydrocracking process. More particularly, it relates to upgrading bottoms of a resulting hydrocrackate product by selective extraction of residual nitrogen-containing and/or polycyclic hydrocarbon impurities from the bottoms.

Nitrogen-containing and polycyclic hydrocarbons are known to adversely affect typical hydrocarbon hydrocracking processes. The former impurities are selectively adsorbed by acid sites (see, for example, U.S. Pat. No. 3,288,703) of the catalyst, thereby inhibiting the desired cracking activity of the catalyst. The latter impurities may also be selectively adsorbed with a like catalyst-inhibiting effect. They are also notorious in their role as precursors of coke formed during hydrocracking. Coke buildup on the catalyst surfaces also interferes with desired catalytic effects and process efficiency. The foregoing effects are especially notable where the bottoms of the hydrocrackate are recycled to the process or used in whole or part as feed to a subsequent hydrocracking process stage. In the recycle mode of operation, these residual impurities tend to persist and build up concentration-wise in the process streams because of their resistance to cracking. Consequently, the relative amount of crackable components of the composite feed to the process declines and the process efficiency also declines. A reject stream is usually employed as a countermeasure. However, this stream normally contains a major portion of crackable feed components which are lost to the process.

An object of this invention is to provide an efficient and economic method for removing residual nitrogen-containing and/or polycyclic hydrocarbon impurities from a hydrocrackate product, especially the bottoms fraction, which is typically subjected to further hydrocracking conditions.

Other objects will become apparent from the following examples and description of the invention.

SUMMARY OF THE INVENTION

In accordance with the present invention, an improvement is provided in a process wherein a hydrocrackable hydrocarbon feedstock is contacted with a hydrocracking catalyst under hydrocracking conditions and bottoms are separated from the resulting hydrocrackate product mixture, said bottoms containing at least one undesirable component selected from the group consisting of residual polycyclic hydrocarbons and nitrogen-containing hydrocarbon impurities, the improvement comprising:

removing at least a portion of said undesirable components from said bottoms by contacting said bottoms under liquid-liquid contacting conditions with a solution of ferric chloride, said solution containing (a) at least a major portion of furfural and (b) an amount of said chloride, based by weight upon said solution, in the range of from about 0.001 to 10%, said extracting conditions including (i) a temperature in the range of from about 0° C. to 50° C., (ii) a solvent-to-feedstock volume ratio in the range of from about 0.1 to 10, and (iii) a resulting bottoms raffinate oil phase having, relative to said bottoms, a reduced content of said undesirable component.

In a preferred aspect of the invention, the aforementioned raffinate oil phase is admixed with fresh feedstock and recycled to the process.

By the term "nitrogen-containing hydrocarbon" as used herein is meant a hydrocarbon derivative in which one or more hydrogen atoms of a hydrocarbon are replaced by one or more nitrogen atoms, e.g., a compound composed of carbon, hydrogen and nitrogen. The nitrogen-containing hydrocarbons herein are unique in that they are residual impurities, that is, they have experienced hydrocarbon hydrocracking conditions and persist as a bottoms component.

The term "bottoms" as used herein is as in the typical sense in connection with hydrocracking a hydrocarbon feedstock, that is, the undistilled remainder after fractionally removing desired hydrocrackate product as overhead in a distillation.

By "liquid-liquid extracting conditions" as used herein is meant by definition ordinary known conditions therefor, including the use of (1) at least sufficient of the extracting liquid to provide separate extract and raffinate phases, and (2) a temperature and pressure at least sufficient to maintain said liquid phases.

For the extracting, any suitable form of apparatus may be used. In general, the various means customarily employed in extraction processes to increase the contact area between the oil stock and the solvent can be employed. Thus, the apparatus used in the present process can comprise a single extraction zone or multiple extraction zones equipped with (a) shed rows or stationary devices to facilitate contacting; (b) orifice mixers; or (c) effective stirring devices such as mechanical agitators, jets of restricted internal diameter, turbo mixers and the like. The operation may be conducted in the batch or continuous-type manner, with the latter being preferred. A continuous countercurrent operation is a preferred mode, for example a mode similar to that described in U.S. Pat. No. 3,205,167 (J. Demeester). Known techniques for decreasing the solvent selectivity of the extracting solvent for hydrocarbons can be employed. Examples of these are the use of small amounts of anti-solvents, e.g., water, during the extraction of the oil with the organic solvent, operating at fairly low temperatures sufficient to effect the desired extraction objective, and using low solvent-to-oil ratios.

By "hydrocrackable hydrocarbon feedstocks" as used herein is meant by definition the heaviest portion of petroleum and similar carbonaceous materials having an initial normal boiling point above 204° C.

Representative feedstocks suitable for use herein are those typically hydrocracked to produce transportation fuels (gasoline, diesel, jet fuel and the like), lubricating oils, middle distillate, light fuel gases and the like, for example including straight-run atmospheric and vacuum gas oils, deasphalted oils, coker gas oils, pitch stripper gas oils, catalytic cycle oils and various heavy or light residual stocks. These feedstocks should contain less than 200 ppmw (calculated as nitrogen), preferably below 100 ppmw, more preferably below 10 ppmw of nitrogen, and much more preferably below 1 ppmw. Typically, the feedstock contains from about 1 to 200 ppmw or more of nitrogen-containing impurities and is also contaminated with sulfur-containing hydrocarbon impurities and may further contain polycyclic hydrocarbons which are especially resistant to hydrocracking conditions, for example coronene and the like.

By "hydrocarbon hydrocracking conditions" as used herein is meant, by definition, the contacting of a typical hydrocrackable hydrocarbon feedstock with a typical hydrocracking catalyst composite comprising a support component selected from the group consisting of (1) one or more amorphous refractory oxides, crystalline zeolitic aluminosilica molecular sieves, crystalline silicalite and mixtures thereof and (2) at least one hydrogenating component selected from the group consisting of the metals, oxides, sulfides and halides of the metallic elements of Groups VIB and VIII of the Periodic Chart of the Elements, said contacting being under typical hydrocracking conditions, including (1) a temperature in the range 232° C. to 454° C., (2) a system pressure in the range 13 to 130 atmospheres, (3) a feed rate in the range 0.1 to 10 V/V/hr., (4) a hydrogen gas rate in the range 89 to 1780 SCM/KL, (5) one or more typical process stages using the same or a different catalyst in each stage, and (6) preferably, but not necessarily, including operating in the partial per-pass conversion mode with recycle to extinction of the product fraction which boils above a predetermined initial boiling point, for example 204° C.

EMBODIMENT

In a preferred embodiment of the invention, an oil derived from coal is converted to product which boils below 204° C. A typical coal oil contains nitrogen-containing and polycyclic hydrocarbon impurities in amounts which severely limit the life of the typical hydrocarbon hydrocracking catalysts. The nitrogenous impurity content of the oil is reduced to below 10 ppmw, preferably below 1 ppmw, by a treatment in which the oil is contacted with a suitable hydrodenitrification catalyst under typical hydrodenitrification conditions. A catalyst especially suitable for this purpose (see, for example, U.S. Pat. No. 3,493,517, J. Jaffe) has the following composition:

| Component | %, Wt. |
|---|---|
| NiO | 12 |
| $MoO_3$ | 23 |
| $SiO_2$ | 19 |
| $Al_2O_3$ | 30 |
| $TiO_2$ | 10 |
| $P_2O_5$ | 6 |

The contacting is carried out under typical hydrodenitrification conditions, including

| | |
|---|---|
| System Pressure, Atm. | 157 |
| Hydrogen Rate, SCM/KL | 1424 |
| Space Velocity, V/V/Hr | 0.5 |
| Starting Temp., °C. | 260, |

the temperature being increased as necessary to obtain a denitrified product containing 1 ppmw of nitrogen.

The low-nitrogen product from the hydrodenitrification treatment is then used as a feed to a hydrocracking process stage. In this stage, the previously denitrified feed is contacted with a catalyst composite having the following composition:

| Component | %, Wt. |
|---|---|
| Palladium | 0.6 |
| $SiO_2$ | 47.6 |

-continued

| Component | %, Wt. |
|---|---|
| $Al_2O_3$ | 31.8 |
| Ultrastable HY Sieve | 20.0 |

as prepared by the method described in U.S. Pat. 3,978,001, J. A. Meyer. The sieve component is added after intermixing of silicaalumina cogel with a precipitated and finely divided palladium component in order that the interior of the sieve component be essentially free of palladium. The contacting in the hydrocracking stage is carried out under typical hydrocracking conditions, including the following:

| | |
|---|---|
| Temperature, °C. | 232–454 |
| System Pressure, Atm. | 14–140 |
| Feed Rate, V/V/Hr. | 0.1–10 |
| Hydrogen Rate, SCM/KL | 89–1780 |

and at a severity which results in about an 85% conversion of the feed to product boiling below 204° C.

The hydrocrackate product resulting from the above hydrocracking stage is fractionally distilled in a typical distillation column into one or more overhead cuts boiling below 204° C. and to bottoms boiling above 204° C. The bottoms constitute about 15% of the feed to the hydrocracking stage. It typically contains 800–1000 ppmw (based on U.V analysis) of polycyclic hydrocarbon impurity and an appreciable amount of nitrogen-containing impurities. The bottoms are passed to a countercurrent liquid-liquid extracting tower wherein they are contacted under ambient conditions of temperature and pressure (ca. 22° C. and 1 atm.) with a furfural solution of ferric chloride containing about 0.2 weight percent of $FeCl_3 \cdot 6H_2O$ at a solvent-to-oil volume ratio of about 0.5. Desirably, the feedstock is equilibrated with the extracting solvent prior to the above contacting, for example by contacting the feedstock with the extract phase of a downstream extractor. The resulting raffinate oil phase typically has a nitrogen content and a polycyclic hydrocarbon content which, relative to the unextracted bottoms is markedly reduced, for example by as much as 30% or more. This raffinate oil is then recycled to the hydrocracking process stage by admixture thereof with fresh hydrodenitrified process feed. The extraction stage serves to prevent buildup in the hydrocracking process stage streams of residual hard-to-crack nitrogen-containing and polycyclic hydrocarbons. It also results, relative to a hydrocracking stage sans an extraction unit, in extended life for the hydrocracking catalyst and an improved operating factor for the process. The estimated yield of extracted oil, based upon bottoms feed, usually exceeds 98%. If desired, prior to recycle of the process, the raffinate oil phase may be water-washed to remove a minor amount of furfural.

Extracting Medium

Conventional extraction liquids have been found to be unsatisfactory for removing residual nitrogenous and/or polycyclic hydrocarbon impurities from a hydrotreated oil. For example, furfural was found to be ineffective in extracting a hydrogenated creosote oil containing about 70 ppmw of residual nitrogen compounds. Thus, after 3 extraction stages using furfural solvent and a 1-to-1 solvent-to-oil volumetric ratio, only about 56% of the nitrogenous component had been removed. This is surprising in view of prior art teaching, for example in British Pat. No. 943,239, or in a paper in Chem. Age. Ind., Vol. 25, 103 (1974) by M. and A. Mokhopadhyay. On the other hand, when the extraction was carried out under the same conditions except that furfural containing about 5 weight percent of ferric chloride was used as the extracting phase, at least 99% of the residual nitrogenous components of the oil were removed. This is a surprising and useful result, especially in view of the fact that no precipitate was formed (see, for example, U.S. Pat. Nos. 2,780,582 and 2,796,387) and little, if any, concurrent polymerization of the furfural solvent occurred. Ferric chloride promotes the extraction by furfural of the residual nitrogenous component of a hydrotreated oil.

At least a major portion of the extracting liquid should be furfural. Thus, when the above-described extraction is carried out under the same conditions except that 50 volume percent of the furfural is replaced by methanol, only about 93% of the nitrogenous component had been removed. The comparative results were as follows:

| Solvent | N Content of Product | Denitrogenation, % |
|---|---|---|
| 5% $FeCl_3 \cdot 6H_2O$ in Furfural | 0.9 | 99 |
| 5% $FeCl_3 \cdot 6H_2O$ in 50/50 Furfural—MeOH | 4.8 | 93 |

Undiluted furfural is therefore superior as an extracting medium to diluted furfural. Preferably the organic solvent employed for the process herein contains at least about 80 volume percent of furfural, and most preferably consists essentially of furfural. Where a diluted solvent is to be used, the diluent is desirably methanol, ethanol, and the like relatively polar organic compounds.

$FeCl_3$ Extraction Promoter

The amount of ferric chloride desirably present in the extracting medium varies, depending in the main upon the amount of nitrogenous component present in the oil feed. The concentration of ferric chloride in the furfural extracting solution should be, based upon solvent, in the range from about 0.001 to 10, preferably 0.01 to 5, and more preferably about 0.1 to 1 weight percent.

Solvent-to-Oil Ratio

The solvent-to-oil volume ratio desirably used varies, depending in the main upon the extracting and the phase-separating temperatures employed. In either case, the temperature should be below about 50° C., and the solvent-to-oil ratio is desirably below about 5, although higher temperatures and solvent-to-oil ratios may be used and yet obtain a useful extraction and phase separation. As temperature is increased, the solubility of oil in the furfural extracting phase, and of furfural in the oil phase, increases. As a result, the efficiency of the process gets smaller with increasing temperatures. Preferably the operating conditions herein include an extracting temperature in the range from about 0° C. to 50° C., and a volumetric solvent-to-oil ratio in the range from about 0.1 to 3, more preferably 10° C. to 30° C. and about 0.4 to 1.5, respectively. In a more particular preferred aspect of the invention, the phase separation is effected at a temperature which is in the range of about 5° to 25° C. lower than the extracting temperature.

EXAMPLES 1–2

A creosote oil was extracted under ambient conditions of temperature and pressure using furfural or a furfural solution of ferric chloride. The oil contained 834 ppmw (U.V. analysis) of polycyclic hydrocarbons (PCH). Conditions and results included the following:

| Ex. No. | $FeCl_3 \cdot 6H_2O$ Conc., Wt. % | Solvent-to-Oil Ratio | Raffinate Yield, Wt. % | PCH, ppmw |
|---|---|---|---|---|
| 1 | 0 | 0.5 | 95 | 673 |
| 2 | 0.1 | 0.5 | 95 | 587 |

In addition, the extracted oil product from Example 2 was significantly cleaner than that from Example 1.

EXAMPLE 3

The unextracted oil described in Examples 1–2 was hydrocracked using a catalyst and conditions comparable to those described above in the preferred embodiment. The hydrocrackate product was an unstable reddish-brown oil which contained considerable polycyclic hydrocarbon precipitate. This product was extracted using the solvent and conditions described in Example 2. The resulting product contained 3 ppmw of PCH.

The foregoing examples demonstrate that hydrocrackate bottoms are markedly improved in terms of reduction in nitrogen-containing and/or polycyclic hydrocarbon impurity contents by the process of the present invention.

It is apparent that many and varied embodiments of this invention may be made without departing from the spirit and scope thereof. The invention is not to be limited except as described in the appended claims.

What is claimed is:

1. In a hydrocracking process wherein a hydrocrackable hydrocarbon feedstock is contacted with a hydrocracking catalyst under hydrocracking conditions and bottoms are separated from the resulting hydrocrackate product mixture, said bottoms containing at least one undesirable component selected from the group consisting of residual polycyclic hydrocarbons and nitrogen-containing hydrocarbon impurities, the improvement comprising:

removing at least a portion of said undesirable components from said bottoms by contacting said bottoms under liquid-liquid extracting conditions with a solution of ferric chloride, said solution containing (a) at least a major portion of furfural and (b) an amount of said chloride, based by weight upon said solution, in the range of from about 0.001 to 10%, said extracting conditions including (i) a temperature in the range of from about 0° C. to 50° C., (ii) a solvent-to-feedstock volume ratio in the range of from about 0.1 to 10, and (iii) a resulting bottoms raffinate oil having, relative to said bottoms, a reduced content of said undesirable component.

2. A process as in claim 1 wherein (1) said feedstock contains an amount of said nitrogen-containing impurities, calculated by weight as nitrogen, in the range of from about 1 to 200 ppmw, (2) said solvent-to-feedstock volume ratio is in the range of 0.1 to 5, and (3) said amount of ferric chloride is in the range of 0.01 to 5.

3. A proces as in claim 2 wherein said solvent contains at least 80 volume percent of furfural.

4. A process as in claim 1 wherein said solvent consists essentially of furfural.

5. A process as in claim 2 wherein (1) said content of nitrogen-containing impurities is in the range 1 to 100 ppmw, and (2) said solvent-to-feedstock volume ratio is in the range 0.1 to 3.

6. A process as in claim 2 wherein (1) said solvent-to-feedstock volume ratio is in the range 0.4–1.5, and (2) said extracting temperature is in the range 10–30° C.

7. A process as in claim 1 wherein said process is carried out in a continuous countercurrent extracting.

8. In a hydrocracking process wherein a mixture of a hydrocrackable hydrocarbon feedstock and recycled bottoms is admixed and contacted with a hydrocracking catalyst under hydrocracking conditions, said bottoms having been separated from a hydrocrackate product mixture and containing at least one undesirable component selected from the group consisting of residual polycyclic hydrocarbons and nitrogen-containing hydrocarbon impurities, the improvement comprising:

(1) removing at least a portion of said undesirable component from said bottoms by contacting said bottoms under liquid-liquid extracting conditions with a solution of ferric chloride, said solution containing (a) at least a major portion of furfural solvent and (b) an amount of said chloride, based by weight upon said solution, in the range of from about 0.001 to 10%, said extracting conditions including (i) a temperature in the range of from about 0° C. to 50° C., (ii) a solvent-to-mixture volume ratio in the range of from about 0.1 to 10, and (iii) a resulting bottoms raffinate oil having, relative to said bottoms, a reduced content of said undesirable component; and (2) recycling said resulting bottoms raffinate oil to form said mixture in the hydrocracking step.

9. A process as in claim 8 wherein (1) said feedstock contains an amount of said nitrogen-containing impurities, calculated by weight as nitrogen, in the range of from about 1 to 200 ppmw, (2) said solvent-to-feedstock volume ratio is in the range of 0.1 to 5, and (3) said amount of ferric chloride is in the range of 0.01 to 5.

10. A process as in claim 8 wherein said solvent contains at least 80 volume percent of furfural.

11. A process as in claim 8 wherein said solvent consists essentially of furfural.

12. A process as in claim 8 wherein (1) said content of nitrogen-containing impurities is in the range 1 to 100 ppmw, and (2) said solvent-to-feedstock volume ratio is in the range 0.1 to 3.

13. A process as in claim 8 wherein (1) said solvent-to-feedstock volume ratio is in the range 0.4–1.5, and (2) said extracting temperature is in the range 10°–30° C.

14. A process as in claim 8 wherein said process is carried out in said continuous countercurrent extracting.

* * * * *